US009850045B2

(12) United States Patent
Wohlgenannt et al.

(10) Patent No.: US 9,850,045 B2
(45) Date of Patent: Dec. 26, 2017

(54) DISPENSING CLOSURE AND CONTAINER WITH SUCH A DISPENSING CLOSURE

(71) Applicant: Aptar Freyung GmbH, Freyung (DE)

(72) Inventors: Herbert Wohlgenannt, Schaffhausen (CH); Bruno Koenigseder, Roehrnbach (DE); Holger Maurer, Tittling (DE)

(73) Assignee: Aptar Freyung GmbH (DE)

( * ) Notice: Subject to any disclaimer, the term of this patent is extended or adjusted under 35 U.S.C. 154(b) by 15 days.

(21) Appl. No.: 15/036,476

(22) PCT Filed: Nov. 14, 2013

(86) PCT No.: PCT/EP2013/073839
§ 371 (c)(1),
(2) Date: May 13, 2016

(87) PCT Pub. No.: WO2015/070910
PCT Pub. Date: May 21, 2015

(65) Prior Publication Data
US 2016/0264317 A1 Sep. 15, 2016

(51) Int. Cl.
*B65D 47/24* (2006.01)

(52) U.S. Cl.
CPC ..... *B65D 47/244* (2013.01); *B65D 2101/003* (2013.01)

(58) Field of Classification Search
CPC ..... B65D 47/244; B65D 2101/003
USPC ..... 222/519–521, 153.06, 153.14
See application file for complete search history.

(56) References Cited

U.S. PATENT DOCUMENTS

| | | | | |
|---|---|---|---|---|
| 4,779,764 | A | 10/1988 | Debetencourt | |
| 5,004,127 | A * | 4/1991 | Morel | B65D 47/244 222/505 |
| 5,421,487 | A * | 6/1995 | Moretti | B65D 47/242 222/153.1 |
| 5,431,305 | A * | 7/1995 | Kaminski | B65D 47/244 222/109 |
| 5,713,493 | A * | 2/1998 | Garibaldi | B65D 47/244 222/153.06 |
| 5,947,331 | A * | 9/1999 | Goncalves | B65D 47/244 222/39 |
| 6,050,452 | A | 4/2000 | Pradinas | |
| 6,299,038 | B1 * | 10/2001 | Schmeisser | B65D 47/242 222/521 |
| 7,677,421 | B2 * | 3/2010 | Lindsay | B65D 47/244 222/507 |

(Continued)

FOREIGN PATENT DOCUMENTS

| | | |
|---|---|---|
| CN | 1915757 A | 2/2007 |
| CN | 2878235 Y | 3/2007 |

(Continued)

OTHER PUBLICATIONS

Search Report dated May 26, 2016 for PCT/EP2013/073839.

*Primary Examiner* — Nicholas J Weiss
(74) *Attorney, Agent, or Firm* — Wood, Phillips, Katz, Clark & Mortimer

(57) ABSTRACT

The present invention relates to a dispensing closure and a container with such a dispensing closure. The dispensing closure comprises a base element, a spout element and a rotatable operating element, wherein the spout element can be axially moved between a retracted position and an extended position.

3 Claims, 8 Drawing Sheets

(56) References Cited

U.S. PATENT DOCUMENTS

| | | | | |
|---|---|---|---|---|
| 2003/0106911 | A1 | 6/2003 | Adams et al. | |
| 2004/0118873 | A1 | 6/2004 | Foster et al. | |
| 2016/0318668 | A1* | 11/2016 | Wuethrich ..... | B65D 1/023 |

FOREIGN PATENT DOCUMENTS

| | | | |
|---|---|---|---|
| EP | 1746040 | A1 | 1/2007 |
| EP | 1820742 | A1 | 8/2007 |
| FR | 2631318 | A1 | 11/1989 |
| NO | 2006093419 | A1 | 9/2006 |

* cited by examiner

DISPENSING CLOSURE AND CONTAINER WITH SUCH A DISPENSING CLOSURE

FIELD OF THE INVENTION

The present invention relates generally to product packaging, in particular to packaging of fluid products and the like. The present invention in particular relates to a closure for a container as well as to a container or parts or subunits of a container with such a closure.

BACKGROUND OF THE INVENTION

Many different types of packages or containers are available for packaging non-solid products of the type which are capable of flowing, such as fluids or fluidized materials, including liquids, pastes, powders, and the like, which substances are collectively and generically referred to herein as "fluids".

Some packages also include a self-sealing dispensing valve, which permits a selected amount of fluid to be discharged from the package, and then reseals to close the package.

Of specific importance are closures for bottles, which contain beverages, especially PET-bottles, which are frequently used for selling beverages, sport drinks etc.

Especially for those kinds of bottles, the closures typically comprise a spout, which extends from an upper part of the closure and which can be inserted into a mouth of a user for drinking. These spouts are typically covered by caps, frequently flip-top caps, in order to cover or protect the spout, while these caps are also frequently used to close a dispensing channel of the spout and to thereby seal the dispensing channel of the spout.

Such closures with spouts are e.g. known from PCT/EP2012/003181 or from PCT/EP2011/001773.

BRIEF SUMMARY OF THE INVENTION

It is an object of the present invention to enhance a dispensing closure, especially for bottles, in which beverages are sold, and it is especially an object of the invention to enhance functionality of such a dispensing closure.

This object is solved by a dispensing closure and a container according to one or more of the claims.

The dispensing closure according to the present invention comprises a base element, which can be attached to a container neck. Typically the attachment is realized by screwing a base element onto a container neck, while preferably the base element comprises an outer skirt having an internal thread, which engages with an outer thread on the container neck.

The dispensing closure according to the present invention also comprises a spout element with a dispensing channel. The dispensing channel preferably extends essentially in a longitudinal direction within the spout, while the borders of the dispensing channel only have to be partly realized by the spout element, while other restrictions to the dispensing channel may be realized by other elements of the dispensing closure. The space defined by or within the dispensing channel may and will typically not be always constant, but will change, depending on an operational status of the closure device, i.e. whether it is in an open position or in a closed position or in an intermediate position, and other elements or parts of other elements may partly or fully be within the dispensing channel, also depending on the operational status of the closure device. A fluid can be dispensed through the dispensing channel or at least part of the dispensing channel, and finally through a dispensing opening.

The dispensing closure further comprises a rotatable operating element, which is arranged such that it is rotatable relative to the base element between a first position and a second position. When said rotatable operating element is in its first position, the dispensing closure is in its closed position, such that no fluid can be dispensed. When said rotatable operating element is in its second position, the dispensing closure is in an open position such that a fluid can be dispensed through the dispensing channel or parts of the dispensing channel.

According to the invention, the dispensing closure and its elements, parts or sub-parts are designed and arranged such that said spout element is in a retracted position, when said operating element is in its first position, wherein the dispending channel of said spout element is closed in said retracted position such that no fluid can be dispensed through said dispensing channel. The dispensing channel of said spout element can be closed at any position within the dispensing channel, preferably at an end position or an outer position near or at a dispensing opening.

According to the invention the dispensing closure and its elements, parts or sub-parts are also designed and arranged such that said spout element is axially movable relative to said base element and arranged such that said spout element is moved axially from said retracted position into an extended position, when said operating element is rotated from its first position to its second position. Said dispensing channel of said spout element is opened when said spout element is in its extended position, such that fluid can be dispensed through said dispensing channel.

Of course, a user can rotate the base element between its first and its second position back and forth, and the spout element will then automatically move axially relative to said base element between its retracted and its extended position, depending on the position of the operating element.

The dispensing closure according to the invention is very easily operable by a user, as the user has to simply rotate the operating element between a first and a second position, i.e. the user can simply rotate the operating element over a predetermined angular distance. This distance is adaptable and is preferably in an area of about 30° and 180°, preferably between about 40° and 120°, and especially preferably between about 70° to 110° between said first and said second position, as these angular distances are distances, which can be easily handled by a user with one movement, i.e. without re-gripping of the operating element being necessary, so that the dispensing closure can be opened fast and easily.

A further advantage of the dispensing closure according to the present invention is that by the realization of an axially movable spout, the spout is brought into a dispensing position or drinking position only when the user wants to drink from the bottle and when the dispensing closure is in its opened position such that fluid can be dispensed. When the dispensing closure is closed, the spout will be in its retracted position, in which the spout only extends from other elements of the dispensing closure by a reduced distance, or, in a preferred embodiment, in which the spout does not extend beyond other elements of the dispensing closure. It is therefore possible to realize a dispensing closure which does not show and does not have an extending spout or in which a spout is completely covered and protected by other elements of the dispensing closure, when the dispensing closure is in its closed position without the necessity of providing a separate cap, like e.g. a flip-top cap.

Furthermore, also the complete dimensions of the closure can be minimized when said closure is in its closed position, as the spout can be retracted into the dimensions of the remaining parts of the dispensing closure, which is not possible with fixed spouts being available in closures in the prior art, while additionally also the cap, covering the closure and possibly sealing the spout in closures of the prior art, leads to an additional height extending even beyond the dimensions of a fixed spout.

Furthermore, the retracted spout is also well covered and protected by the remaining parts of the closure, which ensures that the spout is also not damaged during use, especially e.g. during sportive activities of a user.

The dispensing closure can be therefore arranged such that it essentially looks like a normal, flat cap, so that a closure can be provided, which hardly extends beyond an upper rim of a container neck, while additionally providing a spout for comfortable drinking by extending a spout when needed, without the necessity of removing a cap covering a spout or spout assembly.

According to the present invention the base element comprises a sealing portion which is arranged such that it is positioned within the dispensing channel of the spout element and such that it seals a dispensing opening of the dispensing channel when said spout is in its retracted position. The arrangement of the sealing portion at the base element such that it is positioned within the dispensing channel has the advantage that also the sealing portion is protected from any influence from the outside and potential damages, while this protection is effective in all positions of the spout element. Furthermore, this arrangement has the additional advantage that the sealing portion seals the dispensing channel of the spout element directly at the dispensing opening, therefore at the outermost end of the spout element and the dispensing channel. This has the advantage that the inside of the dispensing channel is always closed to the outside, when said spout element is in its retracted position. This ensures that the inside of the dispensing channel is well protected against dirt or contamination at all time when the closure is in its closed position, so that high hygienic requirements are fulfilled.

In a further preferred realization, the top surface of said sealing portion is also in the same plane as the top surface of the deck portion and/or the top surface of the rim of the spout element. It is therefore possible to realize a closure device which is, in its closed position, essentially flat on the top side, so that it is also possible to realize a closure which extends over the upper rim of a container neck only by a very short distance, e.g. by only 2 or 3 mm, while the spout is well covered and protected within the closure device when said dispensing closure is in its closed position.

According to a preferred embodiment, the base element comprises an inner dome element, which at least partly extends into the inner space of the spout element, especially into the dispensing channel formed by said spout element. Preferably said dome comprises at least one opening, preferably multiple openings, like 3 or 4 openings, which allow a dispensing of fluid, preferably first into the dispensing channel, when said spout is in its extended position. Furthermore said dome preferably comprises the above described sealing portion, preferably arranged at an upper region of the dome. When the spout element is in its closed position, the dispensing opening of the dispensing channel of the spout element is sealed by said sealing portion.

It has to be noted that the at least one opening in said dome can either be directly closed, when said dispensing closure is in its closed position and when said spout element is in its retracted position, however it is also possible that the at least one opening still opens at least partly into the dispensing channel, but the dispensing channel is closed, preferably directly at the dispensing opening, e.g. by a sealing portion of the closure as described above, preferably the sealing portion provided on said inner dome element of said base element.

According to a preferred embodiment, the operating element is rotatable relative to said base element while it is however axially fixed to said base element. This allows an easy handling and an easy realization of the above-described functions and it also allows that the operating element is actuated by a user such that it only rotates and does not extend axially, so that only the spout element is moved into its extended position, when the dispensing closure is in its opened position, i.e. the operating element is in its second position.

According to a preferred embodiment the spout element is coupled to the base element such that said spout element is axially movable relative to the base element, while the spout element is rotationally coupled to said base element, such that no relative rotational movement between spout element and base element is possible. Furthermore, in this preferred embodiment, the spout element is coupled with the operating element such that both an axial and a rotational movement of the spout element relative to the operating element is possible. In this embodiment, furthermore the operating element is coupled to the base element such that said operating element is rotatable relative to said base element, while the operating element is axially fixed to the base element such that no relative axial movement between operating element and base element is possible.

Such a realization is of specific advantage as there is only one rotating element realized in the dispensing closure, namely the operating element, which is rotated relative to the base element by a user, while both the base element and the spout element are rotationally fixed. The spout element is therefore only extending axially from its retracted position into its extended position. This has also the advantage that in case the user should, possibly inadvertently rotate the operating element while having already inserted the partly or fully extended spout element into his mouth, the spout element will not rotate.

This arrangement also is very secure and avoids malfunctions, as relative movements between the elements are minimized. Also the manufacturing costs for such a device can be kept low.

In an alternative embodiment, however, it is also possible that the spout element is coupled to the base element such that the spout element can move both axially and rotationally relative to the base element, while the spout element is coupled to the operating element such that an axial relative movement between these elements is possible while spout element and operating element are rotationally coupled to each other. In this alternative embodiment the operating element is coupled to the base element such that a relative rotational movement between the operating element and the base element is possible, however no axial relative movement between the operating element and the base element is possible, as it is also the case with the above-described embodiment.

In this respect it shall be noted that it is preferred that the dispensing closure according to the present invention comprises a spout element, a base element and an operating element, while all these elements are separate elements, which are directly coupled to each other. However it is also possible to indirectly couple any of these three elements, e.g.

by providing an intermediate element, which couples two or even three of the above-mentioned elements, a spout, a base and an operating element.

According to a preferred embodiment, said base element (100) and said spout element (200) are designed and arranged such that a rotational movement of said operating element (300) from its first position into its second position is only transferred into or leads to an axial movement of the spout element (200) after said operating element (300) has been rotated by a predetermined angle from its first position into the direction of its second position. This embodiment has the advantage that the operating element can be rotated, by a predetermined angle, from its first position into the direction of a second position, while during this movement around a predetermined angle, the spout element is not yet moved into an axial direction. Although therefore the operating element is rotated by a predetermined angle out of its first position, the dispensing closure is still in its closed position and especially the dispensing opening is not yet opened, but still closed.

The predetermined angle is preferably arranged such that during a first rotation of the operating element out of its first position, when opening the dispensing closure for the first time, a tamper evident element is destroyed while said operating element is moved around the predetermined angle, while only thereafter and during the continued rotation of the operating element into its second position the spout element is axially moved into its retracted position.

It is thereby secured that the dispensing opening will only be opened for the first time after a tamper evident element or multiple tamper evident elements have been destroyed.

Preferably, the predetermined angle, around which the operating element is rotated before this rotation is transferred into an axial movement of the spout element, is in the area of about 1° to 40°, more preferably in a range of about 5° to 30° and especially preferably in a range of 10° to 20°.

According to a further preferred embodiment, said dispensing closure is designed and arranged such that a force exerted onto said spout element (200) in an axial direction and in a direction towards its retracted position cannot be transformed into a force acting onto said operating element in a direction which would support a rotational movement of the operating element (300) into the direction of its second position, when said operating element (300) is in its first position. This embodiment has the advantage that a force exerted onto the spout element in an axial direction and in a direction of its retracted position, as it can e.g. occur in case there is a pressure in the container closed by the dispensing closure being higher than the outside or atmospheric pressure, which can especially occur frequently in case the container contains a carbonized liquid, will not lead to a force which could act in a direction such that a rotational movement of the operating element is supported. Such a realization of the dispensing closure would therefore ensure that the dispensing closure is not inadvertently opened or an inadvertent opening of the closure being at least partly supported by an internal higher pressure of the container.

One possibility to realize such an embodiment would be to provide the spout element with an external thread element or protrusion, which interacts or engages with a corresponding internal thread element of the operating element, whereas the thread elements are arranged such that a rotation of the operating element is transferred into an axial movement of the spout element only after the operating element is rotated from its first position into its second position beyond a predetermined angle.

According to a preferred embodiment, the operating element comprises at least one thread element, interacting with or engaging with a corresponding thread element of the spout element, while the thread element of the operating element has an essentially helical form over a predetermined angle or area, while it has an essentially ring-like form over a second predetermined angle or range. In this second predetermine angle or range, the threading element extends essentially in horizontal direction and preferably does not have a pitch.

According to a still further embodiment, the operating element does have at least two thread elements, which define a guiding groove between them for guiding a corresponding thread element or protrusion of the spout element, while these two thread elements of the operating element are arranged such that the distance between these two elements is narrowing by a predetermined amount such that the corresponding thread element or protrusion of the spout element is clammed between these thread elements when said spout is in its retracted and/or in its extended position or such that at least the friction between the thread element or the protrusion of the spout element and the thread elements of the operating element are increased when said spout is in its retracted and/or in its extended position. This will lead to the effect that a higher force will have to be applied initially, when the user wants to move the spout out of its retracted or extended position.

According to a preferred embodiment, the dispensing closures and the elements of the dispensing closures are designed and arranged such that in the closed position of the dispensing closure, when said spout element is in its retracted position, a top surface or area of the dispensing closure is essentially flat. This can be realized such that a top surface of a deck portion of the operating element and a top surface of a rim of the spout element, which defined the top-most part of the spout element, are in the same plane when said spout is in its retracted position, i.e. when said dispensing closure is in its closed position.

In a preferred embodiment, the operating element comprises a skirt or a side wall and at least one projection, which extends radially inwardly from the side wall or skirt, preferably from an inner part of said side wall, such that it can engage with and/or into a corresponding groove of said base element. Thereby the operating element can be axially fixed to said base element, while still a relative rotational movement between these elements is possible, while these means are easy to manufacture at low costs, still being very reliable. It is also possible to realize the at least one projection and the corresponding groove such that the operating element can be axially pushed onto said base element during manufacturing, thereby realizing a snap-on connection, which also enhances the manufacturing process.

In a preferred embodiment, there are multiple projections provided at the operating element, preferably arranged around the circumference of the operating element and preferably arranged in essentially equal angular distances.

In a preferred embodiment, at least 3 such projections are provided, however also more projections, e.g. 8 projections, can be provided. Preferably there are distances between each of the projections, as this enhances the flexibility of the operating element such that the snap-on function, as described above, can still be realized.

In a further preferred embodiment the operating element comprises a side-wall and a top wall which are arranged such that the operating element completely covers a top surface and an outer side-wall of the base element such that neither the top surface nor the outer side-wall of the base element can be gripped or directly operated by the user. Preferably, the operating element is arranged such that neither the top surface nor the outer side wall of the base element can even be touched by a user as being completely covered by said operating element. This has the advantage that the base element can also not be operated directly by a user. The only element, which can be directly touched and manipulated and operated by a user is therefore the operating element. This has the advantage that the user automatically operates on the operating element and does not, by error, rotate the base element, thereby possibly detaching the complete closure from the container.

In a preferred embodiment the dispensing closure according to the present invention also comprises a tamper-evident element, which is attached to said base element by at least one connection member, while preferably multiple connection members are provided, preferably also arranged around the circumference of the base element, preferably also in essentially equal angular distances. Furthermore, the operating element comprises at least one destruction element arranged such that it breaks the at least one connection member, when said operating element is rotated for the first time out of its first position, preferably by a predetermined angle, and at least into the direction of the second position, while preferably the at least one connection member is destroyed already well before the operating element reaches the second position. The predetermined angle is preferably in a range of 1° to 40°, more preferably in a range of 5° to 30° and especially preferred in a range of 10° to 20°. Preferably, the device comprises as many destruction elements as it comprises connection members, so that each connection member can be destroyed by a corresponding destruction element.

Such a tamper-evident element is preferably realized as a ring-like element, which is preferably arranged at a lower portion of the dispensing closure, so that, after destruction of the at least one connection member, the tamper-evident element falls away by a certain distance from the dispensing closure, so that it is easily visible to the user that the dispensing closure had been opened at least once.

In a preferred embodiment, the base element of the dispensing closure comprises an extension portion, which is arranged such that it extends into an opening of a container neck when said dispensing closure is attached to the container neck. Such an extension portion can therefore fulfill the function of a "plug element", sealing the bottle neck or the dispensing opening in the bottle neck against the dispensing closure, so that a fluid stored in the container or bottle can be dispensed only through the dispensing channel and the dispensing opening of the dispensing closure.

Preferably the base element comprises two walls, which extend concentrically such that they cover the rim of the container neck on both sides and thereby seal the base element against the container neck.

The present invention also relates to a container for storing a fluid, especially a liquid, with a container neck and a dispensing opening within said container neck, said container having a dispensing closure as described above attached to said container neck.

In a preferred embodiment, the dispensing closure and container are separate elements so that both container and dispensing closure can be manufactured separately, while the readily manufactured dispensing closure can then be attached to the container and the container neck, typically by screwing it onto the container neck as described above.

However, it is also possible that the container and the base element are formed as a unitary element. It is e.g. possible to directly manufacture the base element and the container neck together, possibly including the complete container or bottle or part of the bottle or the container, e.g. by injection molding. It is, however, also possible to manufacture the elements separately and to e.g. glue or fuse the base element to the container neck thereafter.

Preferably, the neck of the container extends about a certain, predetermined distance such that, in a longitudinal direction, there is a predetermined distance between the lower rim of the side wall or skirt either of the operating element or the base element and a shoulder of the container. This has the advantage that in case a tamper-evident element is provided, the tam-per-evident element can fall away from the remaining part of the closure by a visible distance, so that it is easily recognizable for a user whether the dispensing closure had been opened at least once or whether the dispensing closure has not yet been opened, securing an integrity of the content of the container.

BRIEF DESCRIPTION OF THE DRAWINGS

The above-described features and further features and advantages will become even more apparent in view of the following description of the preferred embodiments shown in the drawings.

DETAILED DESCRIPTION OF THE PREFERRED EMBODIMENTS

Figure 1:
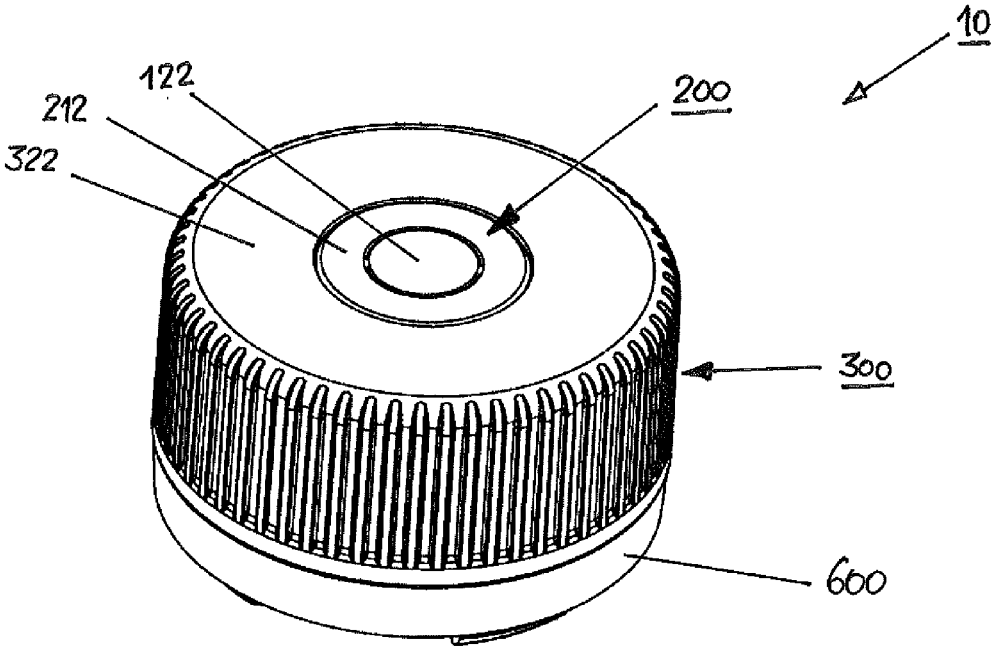
FIG. 1 shows a perspective view of an embodiment of the dispensing closure according to the invention, while the dispensing closure shown in FIG. 1 is in its closed position.
Figure 2:
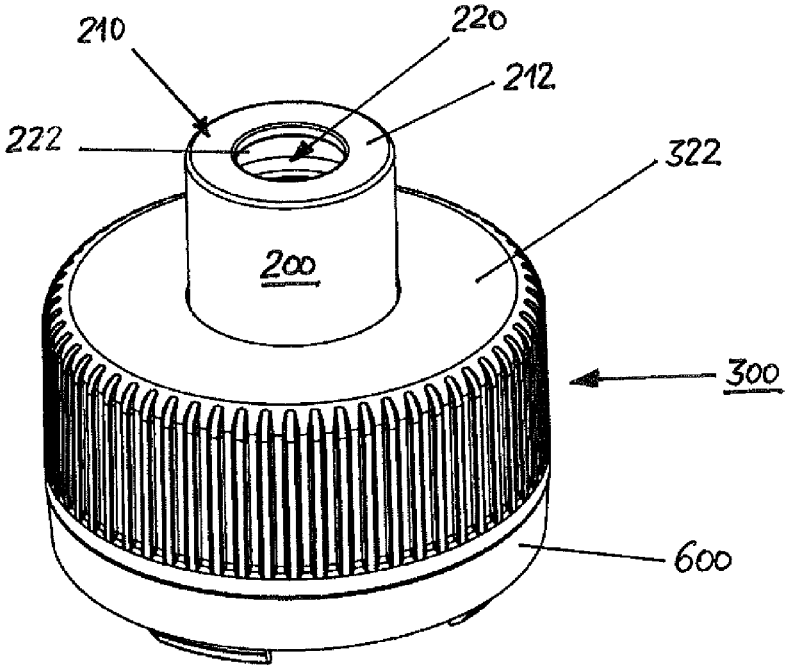
FIG. 2 shows a perspective view of an embodiment of the dispensing closure according to the invention, while the dispensing closure shown in FIG. 2 is in its opened position.

FIGS. 1 and 2 do show a perspective view of an embodiment of a dispensing closure 10 according to the present invention, wherein FIG. 1 shows the dispensing closure 10 in its closed position and FIG. 2 shows the dispensing closure 10 in its opened position.

Figure 3:
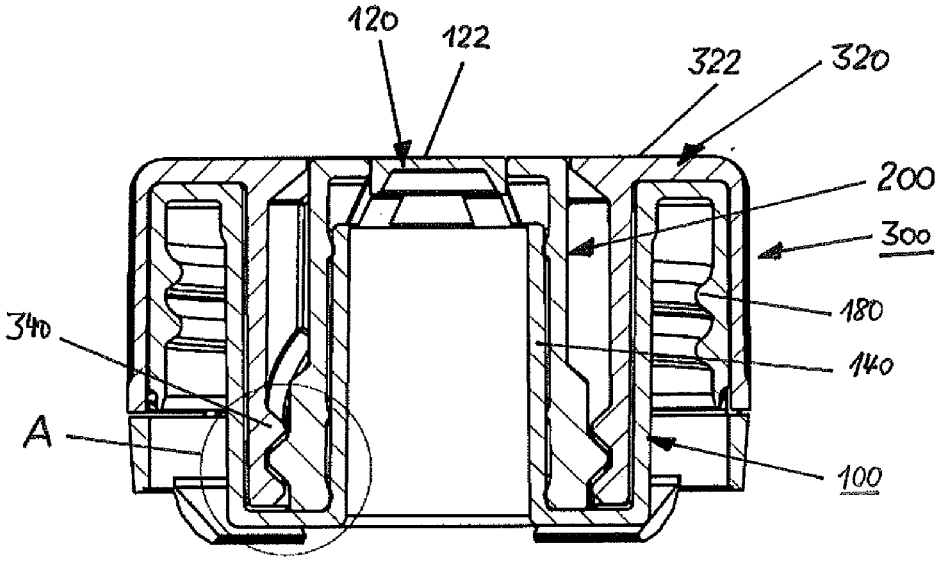
FIG. 3 shows a cross-section through an embodiment of the dispensing closure according to the invention, while the dispensing closure shown in FIG. 3 is in its closed position.
Figure 4:
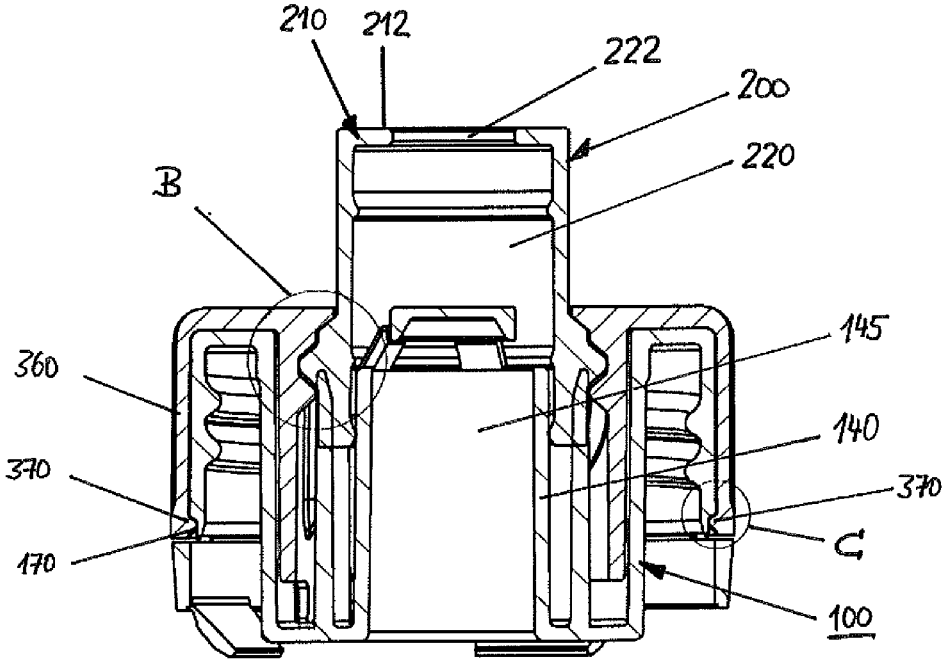
FIG. 4 shows a cross-section through an embodiment of the dispensing closure according to the invention, while the dispensing closure shown in FIG. 4 is in its opened position.
Figure 8:
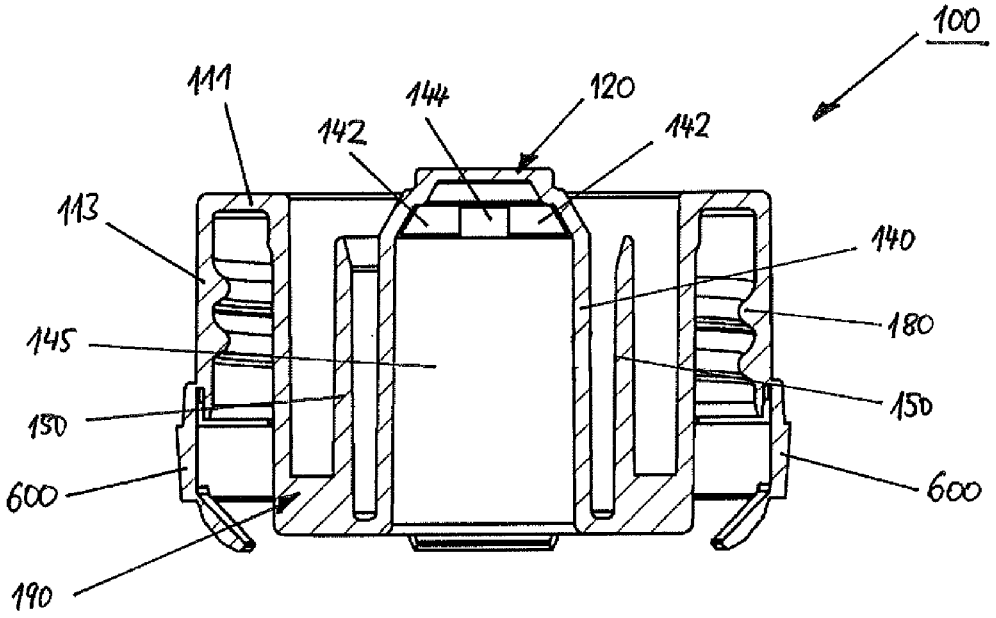
FIG. 8 shows a cross-section of an embodiment of a base member of a dispensing closure according to the present invention.

The dispensing closure 10 comprises an operating element 300 and a spout element 200 as well as a base element 100 (see especially FIGS. 3, 4 and 8). Dispensing closure 10 also comprises a tamper-evident element 600, the function of which is described in connection with FIGS. 9 and 10.

When the dispensing closure 10 is in its closed position, the spout element 200 is in its retracted position. As can be well seen in FIG. 1, the dispensing closure 10 has an essentially flat upper or top surface, while the top surface 322 of the operating element 300, the top surface 212 of an upper rim 210 of the spout element 200, and a top surface 122 of a sealing element 120 of the base element 100 are all in the same plane. The spout element is therefore fully retracted into the dispensing closure 10, so that the spout element 200 is fully protected, when it is in its retracted position and when the dispensing closure 10 is in its closed position.

As can be also well seen in FIG. 1, a sealing element 120 (see FIG. 3 or FIG. 8) seals the inner part of the spout element 200, so that no fluid or liquid can be dispensed from the container.

FIG. 2 shows the dispensing closure 10 in its opened position, with the spout element 200 being in its extended position. As can be well seen, the spout member 200 extends well beyond the upper or top surface 322 of the operating element 300, so that a user can put the spout member 200 into his mouth for drinking.

As can be also well seen in FIG. 2, the dispensing opening 222 is, due to the extended position of the spout element 200, not sealed anymore by sealing element 120 (see FIG. 3 or FIG. 8), so that fluid or liquid can be dispensed from the container through a dispensing channel 220 and through the dispensing opening 222.

FIGS. 3 and 4 show cross-sectional views of the embodiment of the dispensing closure 10 as shown in FIGS. 1 and 2, wherein FIG. 3 shows the dispensing closure 10 in its closed position (as in FIG. 1), and wherein FIG. 4 shows the dispensing closure 10 in its opened position (as in FIG. 2). The planes of the cross-sections in each of the figures are selected such that the engagement of the spout element with the operating element is best visible.

As can be well seen in FIG. 3, the dispensing closure 10 comprises a base element 100, which can be attached to a neck of a container (not shown), whereas in this embodiment it can be screwed onto a container neck by means of an internal thread 180, as can be also well seen in FIG. 8, showing the base element 100 in an isolated form.

The base element 100 comprises an inner dome 140, which has, at its upper part, a sealing portion 120. The sealing portion 120 is connected with an essentially cylindrical side wall of the inner dome element 140 via webs 144. Between the webs 144 there are openings 142, being arranged such that a fluid or liquid can be dispensed from the container through the inner space 145 of the inner dome element 140 and then through the openings 142 into the dispensing channel 220 of the spout element 200 and finally through the dispensing opening 222.

Figure 5:
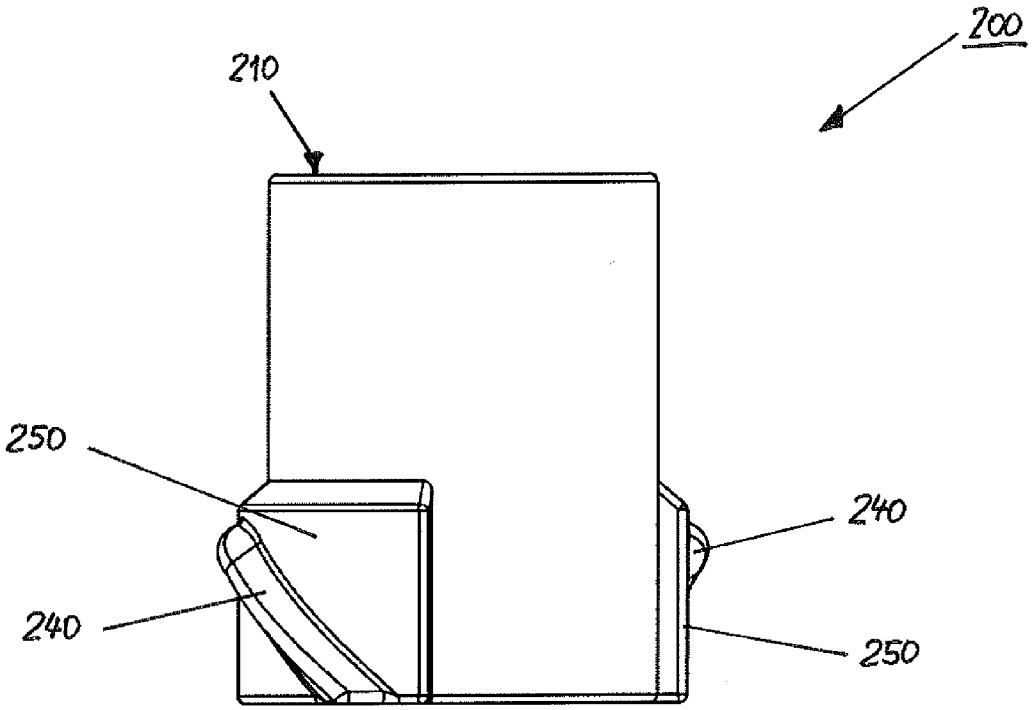
FIG. 5 shows a side view of an embodiment of a spout element of a dispensing closure according to the invention.
Figure 6:
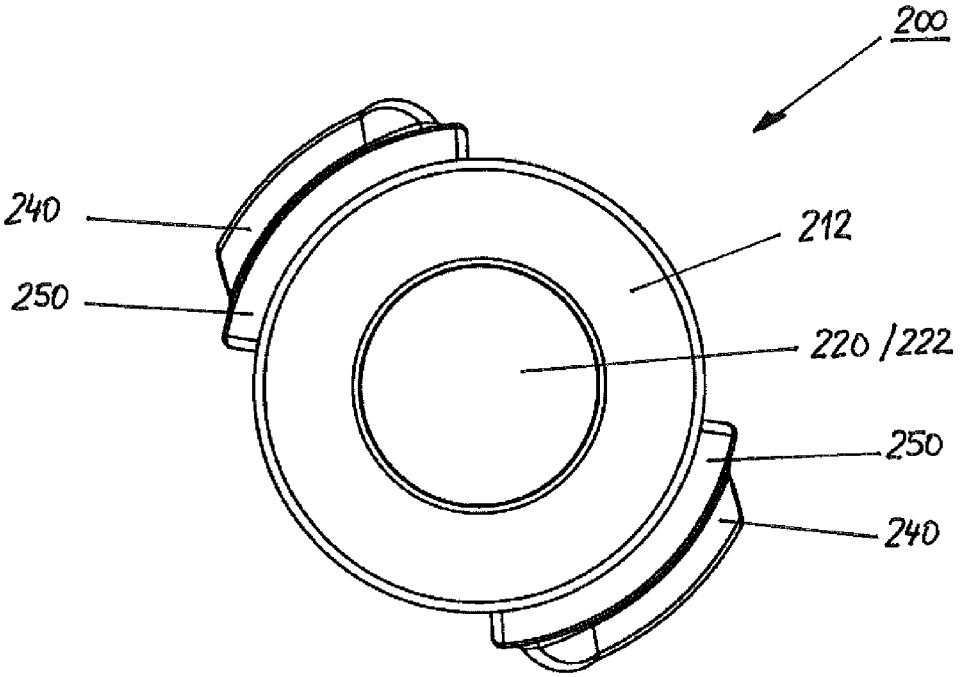
FIG. 6 shows a top view on the spout element as shown in FIG. 5.
Figure 7:
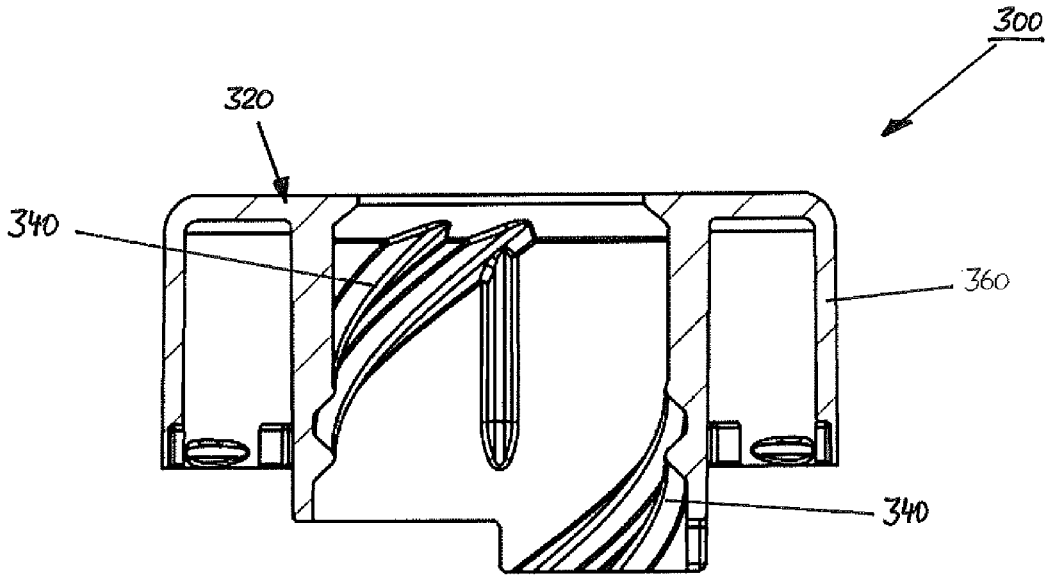
FIG. 7 shows a cross-section of an embodiment of an operating element of a dispensing closure according to the invention.

As can be well seen in FIGS. 5 and 6, in connection with FIGS. 3 and 4, the spout element 200 has partial external thread elements 240, which engage with corresponding threads 340 of the operating element 300, see especially also FIG. 7. Spout element 200 and base element 100 are therefore threadingly engaged, so that the spout element 200 performs a spiral movement relative to the operating element 300, when said operating element 300 is rotated.

The spout element 200 is rotationally fixed to the base element 100 by means of the protrusions 250, see FIG. 5 and FIG. 6, which are arranged on the outer side wall of the spout element 200 and which engage with corresponding protrusions 150 in the base element 100, so that the spout element 200 can move only axially relative to said base element, but does not rotate relative to said base element 100.

As can be well seen in FIG. 7, also the inner thread elements 340 are only partial threads of the operating element 300, in order to engage with the corresponding outer thread elements 240 of the spout element 200.

In FIG. 3, see especially circle A, it can be well seen that the spout element 200 abuts, in the closed position of the dispensing closure 10 and therefore in the fully retracted position of the spout element 200, against the base element 100, so that an end position, namely the closed position is defined.

As can be well seen in FIG. 4, see circle B, the spout element 200 abuts also against a part of the operating member 300 in the other end position, namely the fully extended position of the spout element 200 and the opened position of the dispensing closure 10.

As can also be seen in FIG. 4, see especially circle C, the operating element 300 has various projections 370 extending radially inwardly from an inner part of the side wall 360. These projections 370 engage with corresponding grooves 170 of the base element 170, so that the operating element 300 can be axially fixed relative to the base element 100, while still a relative rotational movement of the operating element 300 relative to the base element 100 is possible. The maximum rotating angle is determined by the dimensions of the grooves 170 on the one hand and the dimensions of the protrusion 370 on the other hand, when considered in a circumferential direction.

In the embodiment shown, the maximum rotational angle, around which the operating element 300 can be rotated relative to the base element 100, is about 90°, however also other maximum angular rotation ranges can be determined and set, if desired.

Figure 9:
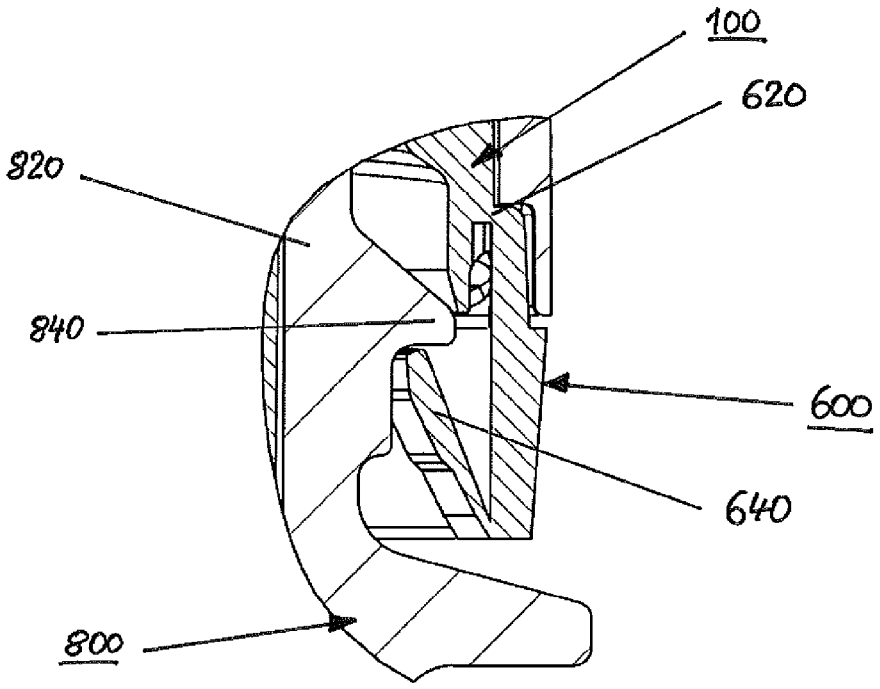
FIG. 9 shows a partial cross-sectional view of an embodiment of a dispensing closure according to the invention attached to a neck of a container, with a tamper-evident element before a first opening of the dispensing closure.
Figure 10:
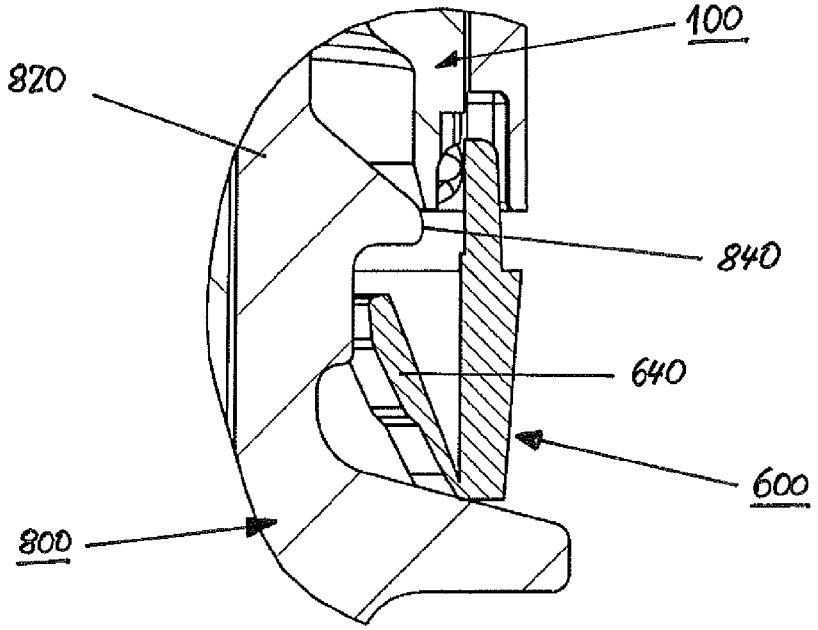
FIG. 10, shows a partial cross-sectional view of an embodiment of a dispensing closure according to the invention attached to a neck of a container, with a tamper-evident element after a first opening of the dispensing closure.

FIGS. 9 and 10 do show a partial cross-section through an embodiment of a dispensing closure according to the invention, being attached to a bottle neck 820 of a bottle 800, wherein this embodiment of the dispensing closure 10 comprises a tamper-evident element 600.

As can be well seen in FIG. 9, showing the dispensing closure 10 before a first opening, a tamper-evident element 600 is attached, via connections or connection members 620, to a side wall of the base element 100. The tamper-evident element 600 has an extension 640, so that the lower part of the tamper-evident element is essentially V-shaped.

When the dispensing closure 10 is attached to the bottle neck 820 for the first time, e.g. by screwing it onto the bottle neck, the extension 640 of the tamper-evident element 600 can be flexed readily outwardly, when having to pass a ring-like protrusion 840, which extends ring-like around the outer side of the bottle neck 820.

As soon as the upper end of the extension 640 of the tamper-evident element 600 has passed the protrusion 840, it moves inside, due to its elasticity, so that the dispensing closure cannot be unscrewed and removed from the bottle neck anymore without destroying the tamper-evident element 600 at least partly.

When the operating element 300 is moved for the first time out of its first position, i.e. when opening the dispensing closure for the first time, destruction elements, being arranged at the operating element 300, destroy the connections 620, so that the tamper-evident element 600 is separated from the base element 100 and falls down onto a shoulder of the bottle 800, clearly indicating to a user that the dispensing closure had already been opened.

Figure 11:
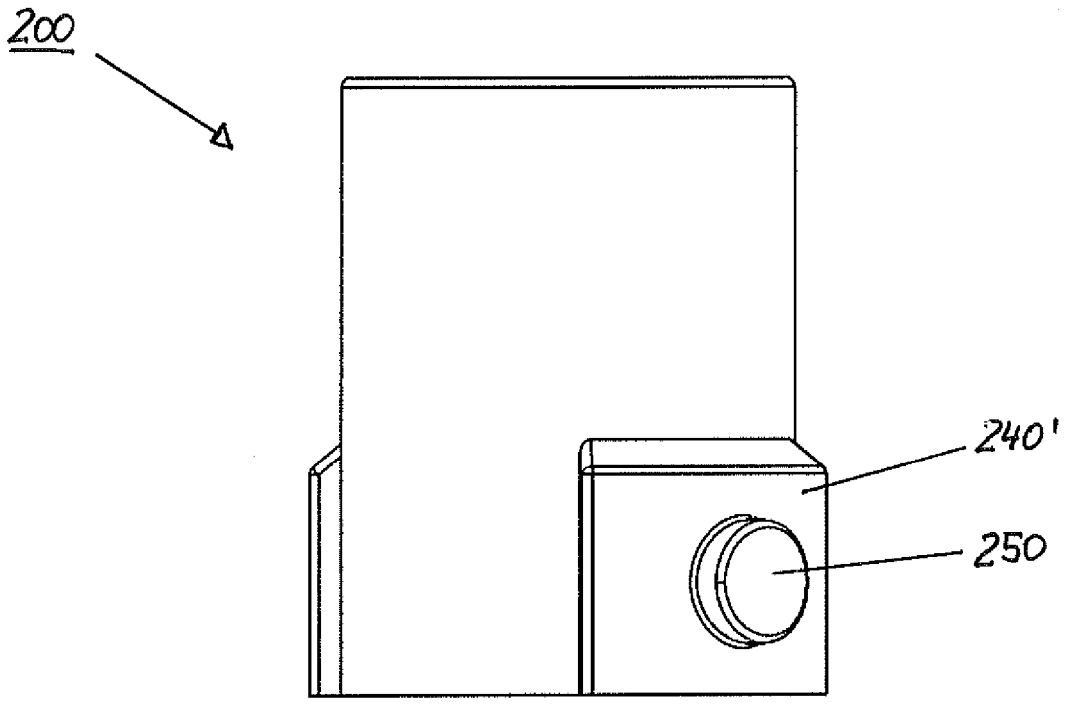
FIG. 11 shows a side-view of another embodiment of a spout element of a dispensing closure according to the invention.

FIG. 11 shows a side view of another embodiment of the spout element which is similar to the spout element as shown in FIG. 5, so that it is, in order to avoid repetitions, referred also to the description of FIG. 5 above, and it has to be noted that the same or similar elements are indicated with the same reference numbers.

In comparison with the spout element shown in FIG. 5, the spout element 200 shown in FIG. 11 comprises a different external thread element (240, see FIG. 5) in form of a protrusion 240' which has an essentially circular cross section and which extends in a radially outward direction beyond the protrusions 250.

Similarly as to the embodiment of the spout element shown in FIG. 5, the protrusion 240' interact with corresponding inner thread elements (340) of the operating element (300, see e.g. FIG. 7).

It has to be noted that the form of the protrusion 240' in this embodiment is essentially circular, however also other forms are possible, for example an essentially rectangular form or even an essentially square-like form, or also an essentially triangular form.

Figure 12:
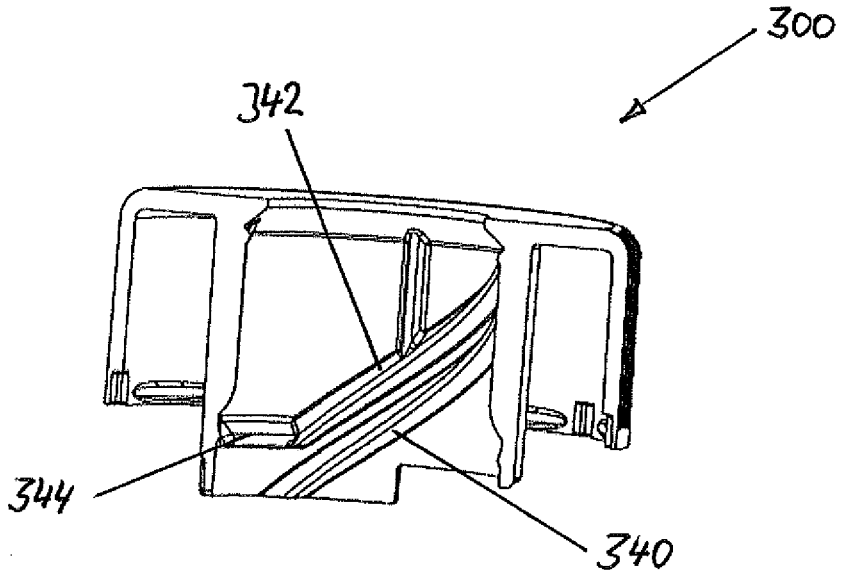
FIG. 12 shows a cross-section of another embodiment of an operating element of a dispensing closure according to the invention.

FIG. 12 shows a cross-section of another embodiment of an operating element 300 of a dispensing closure, which is similar to the embodiment as shown in FIG. 7, so that the same or similar elements are denoted with the same reference number, and it is referred to the description of the embodiment shown in FIG. 7, in order to avoid repetitions.

As can be well seen, the embodiment of the operating element 300 shown in FIG. 12 has two inner thread elements 340, 342, while the second thread element 342 has, at its lower area, a portion 344 which does not extend essentially helically within the operating element 300, but which remains on the same height or vertical position of the operating element 300, i.e. it has no pitch in this portion 344.

This has the effect that during an initial rotation of the operating element 300 from its first position, in which the dispensing closure is in its closed position, the spout is not yet moved in an axial direction, i.e. the spout element is not yet moved in an outward direction. Only after an initial rotation around a predetermined angle, preferably an angle between 1° and 40°, more preferably between 10° and 20°, the corresponding external thread element 240, 240' of the spout element 200 engages with both internal thread elements 340 and 342 such that the rotation of the operating element also leads to an axial movement of the spout element, so that the spout element is moved outwards or upwards.

This specific embodiment has the advantage that during the initial rotation of the operating element 300 around a predetermined angle, the closure is still in its closed position, while preferable during this initial rotation around the predetermined angle, a tamper evident element is destroyed. It can thereby be secured that the tamper evident element or the tamper evident elements are first destroyed before the dispensing opening is opened even partly, which leads to an enhanced tamper evident system.

Figure 13:
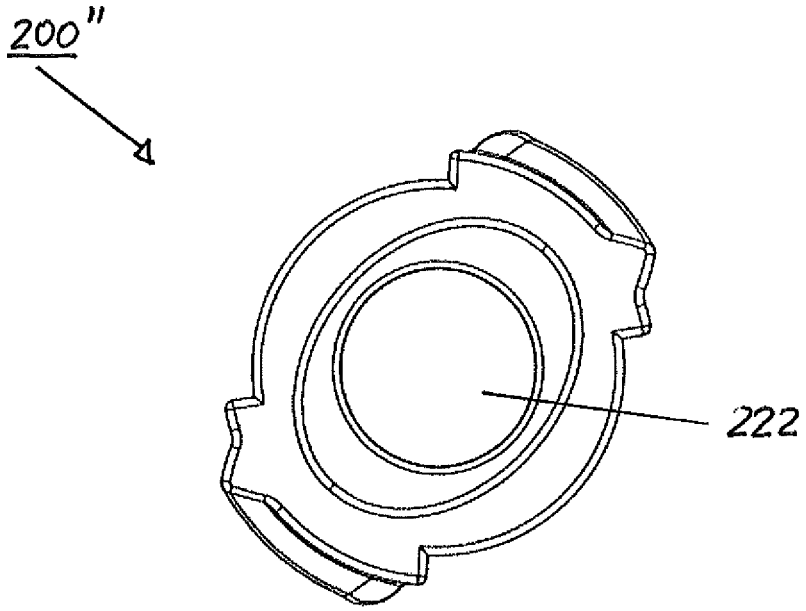
FIG. 13 shows a view from the lower side of another embodiment of the spout element according to the present invention.
Figure 14:
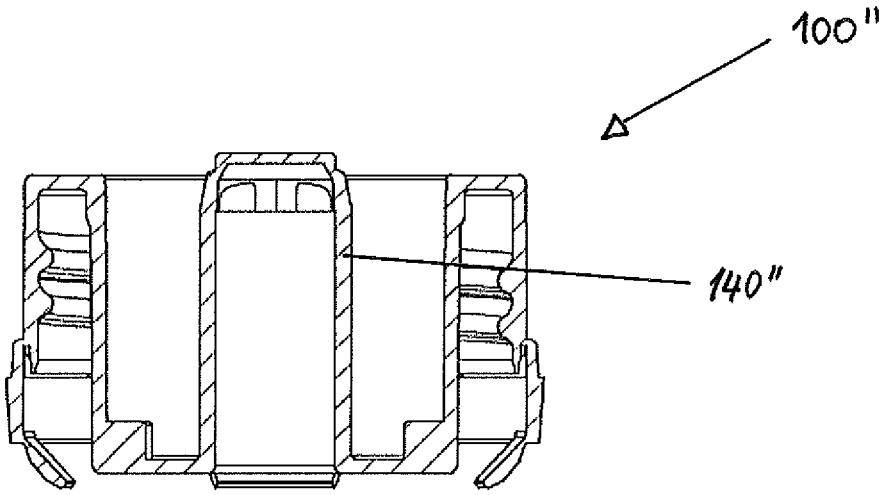
FIG. 14 shows a cross-section of another embodiment of a base member of a dispensing closure according to the present invention which can be used with an embodiment of the spout element as shown in FIG. 13.
Figure 15:
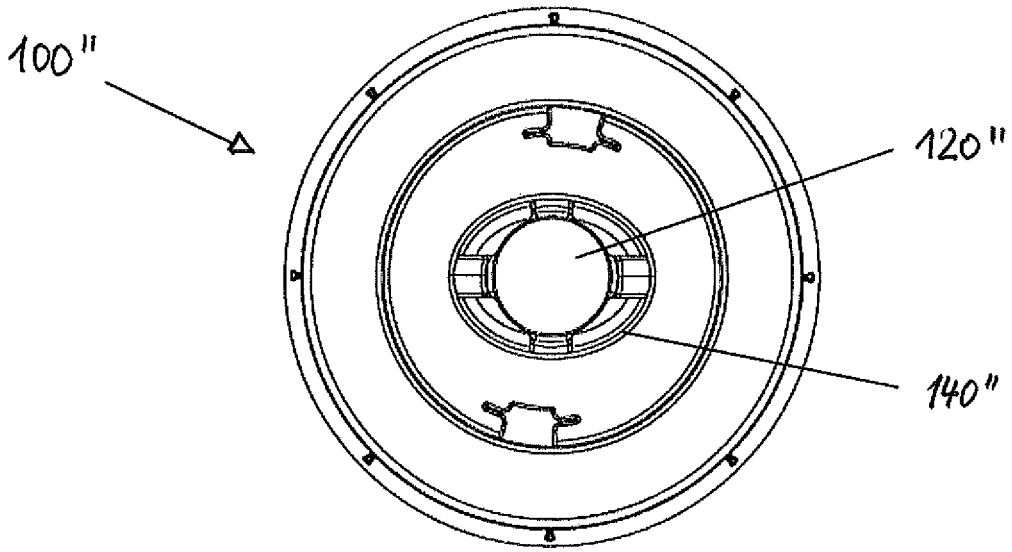
FIG. 15 shows a view of the embodiment of the base member as shown in FIG. 14.

FIGS. 13 to 15 do show another embodiment of a base element 100" and a corresponding spout element 300", which are similar to the embodiments described above, so that the same or similar elements are denoted with the same or similar reference numbers, and it is also referred to the above-mentioned description in order to avoid repetitions.

As can be well seen in FIG. 13, the spout element 300" has an essentially circular outer surface, so that it can still rotate relative to the operating element, such that the spout member 300" can extend through the circular upper opening of the operating element 300. However, the inner form of the spout element 300" is essentially oval and corresponds to an oval outer form of an inner dome element 140" of the base element 100". By the corresponding oval forms it is secured that the base element 100" and the spout element 300" are rotationally coupled.

The functional interrelationship of these elements is therefore essentially the same as with the elements described above, however in the base element 100", the protrusions (150, see FIG. 8) are not necessary anymore, as the spout element 300" and the base element 100" are rotationally coupled by the corresponding oval forms or contours of these elements.

FIG. 15 very well shows the oval outer contours of the inner dome 140" of the base element 100", while FIG. 13 very well shows both the oval form of the inner contour and the circular form of the outer contour of the dome element 300", as well as the circular opening 222" which is closed by a corresponding, also essentially circular sealing portion 120 of the base element 100" (see FIG. 15).

The features of the present invention disclosed in the specification, the claims and/or in the accompanying drawings may, both separately and in any combination thereof, be material for realizing the invention in various forms thereof.

What is claimed is:

1. A dispensing closure comprising:

a base element (100) which can be attached to a neck (820) of a container;

a spout element (200) with a dispensing channel (220), said spout element (200) arranged such that it is axially movable relative to said base element (100) between a retracted position and an extended position, and an operating element (300), which is arranged such that it is rotatable relative to said base element (100) between a first position and a second position, wherein said base element (100),said spout element (200) and said operating element (300) are arranged such that said spout element (200) is in said retracted position when said operating element (300) is in said first position, wherein said dispensing channel (220) of said spout element (200) is closed in said retracted position such that no fluid can be dispensed through said dispensing channel (220), and said spout element (200) is moved axially relative to said base element (100) from said retracted position into said extended position when said operating element (300) is rotated from said first position to said second position, wherein said dispensing channel (220) of said spout element (200) is opened in said extended position such that a fluid can be dispense through said dispensing channel (220), wherein said based element (100) comprises a sealing portion (120),which is arranged such that it is at least partly positioned within the dispensing channel (220)

of said spout element (200) and such that it seals a dispensing opening (220) of said dispensing channel (220) when said spout element (200) is in said retracted position, and a tamper-evident element (600) attached by at least one connection member (620) to said base element (100), wherein said operating element (300) comprises at least one destruction element arranged to break said at least one connection member (620) when said operating element (300) is rotated by a predetermined angle out of said first position for the first time.

2. The dispensing closure according to claim 1, wherein said tamper-evident element (600) is a ring-like element.

3. The dispensing closure according to claim 1 in combination with a container for storing a fluid, said container having a container neck (820) and a dispensing opening within said container neck (820), said closure being attached to said container neck (820), wherein said container neck (820) and said tamper-evident element (600) are configured and initially located relative to each other so that said tamper-evident element (600) can fall a predetermined distance away from an original position when said at least one connection member (620) is destroyed.

* * * * *